US007804392B2

(12) United States Patent
Jahn et al.

(10) Patent No.: US 7,804,392 B2
(45) Date of Patent: Sep. 28, 2010

(54) SWITCHING RESISTOR FOR AN ELECTRIC SWITCHING DEVICE

(75) Inventors: Heiko Jahn, Hemsbach (DE); Lutz-Rüdiger Jänicke, Mahlow (DE)

(73) Assignee: Siemens AG, Munich (DE)

( * ) Notice: Subject to any disclaimer, the term of this patent is extended or adjusted under 35 U.S.C. 154(b) by 532 days.

(21) Appl. No.: 11/816,573

(22) PCT Filed: Feb. 17, 2006

(86) PCT No.: PCT/EP2006/060058

§ 371 (c)(1), (2), (4) Date: Aug. 17, 2007

(87) PCT Pub. No.: WO2006/087372

PCT Pub. Date: Aug. 24, 2006

(65) Prior Publication Data

US 2008/0258861 A1 Oct. 23, 2008

(30) Foreign Application Priority Data

Feb. 17, 2005 (DE) ..... 10 2005 008 313

(51) Int. Cl.
*H01C 8/00* (2006.01)

(52) U.S. Cl. ..... 338/224; 338/260

(58) Field of Classification Search ..... 338/223–226, 338/260

See application file for complete search history.

(56) References Cited

U.S. PATENT DOCUMENTS

| | | | | |
|---|---|---|---|---|
| 4,365,128 | A | 12/1982 | Mascher | |
| 4,418,256 | A | 11/1983 | Graf | |
| 4,967,176 | A * | 10/1990 | Horsma et al. | 338/22 R |
| 5,247,277 | A * | 9/1993 | Fang et al. | 338/22 R |
| 5,379,022 | A * | 1/1995 | Bacon et al. | 338/20 |
| 5,629,658 | A | 5/1997 | Chen | |
| 5,737,160 | A | 4/1998 | Duffy | |
| 5,977,862 | A | 11/1999 | Pham | |
| 2003/0183187 | A1 | 10/2003 | Menzel et al. | |

FOREIGN PATENT DOCUMENTS

| | | |
|---|---|---|
| CH | 653 477 A5 | 12/1985 |
| DE | 29 49 753 A1 | 6/1981 |
| DE | 29 49 753 C2 | 6/1981 |
| DE | 195 10 100 A1 | 9/1996 |
| DE | 693 05 942 T2 | 3/1997 |
| DE | 689 28 461 T2 | 4/1998 |
| DE | 102 12 042 C1 | 8/2003 |

(Continued)

OTHER PUBLICATIONS

United States Patent US 4,418,256 (Graf), dated Nov. 29, 1983, and corresponding Swiss Patent CH 653 477 A5, dated Dec. 31, 1985.

(Continued)

*Primary Examiner*—Kyung Lee
(74) *Attorney, Agent, or Firm*—Laurence A Greenberg; Werner H Stemer; Ralph E Locher

(57) ABSTRACT

A switching resistor for an electric switching device having an electrically conductive resistive material. The resistive material is a resistive material on a synthetic material basis.

14 Claims, 2 Drawing Sheets

FOREIGN PATENT DOCUMENTS

| | | | |
|---|---|---|---|
| DE | 697 25 692 | T2 | 7/2004 |
| EP | 0 362 308 | B1 | 4/1990 |
| EP | 0 588 136 | B1 | 3/1994 |
| EP | 0 853 322 | B1 | 7/1998 |
| EP | 1 431 984 | A1 | 6/2004 |
| FR | 2 733 353 | | 10/1996 |
| JP | 2001085203 | A | 3/2001 |
| JP | 2003293701 | A | 10/2003 |

OTHER PUBLICATIONS

United States Patent Application Publication US 2003/0183187 A1 (Menzel et al.), dated Oct. 2, 2003, and corresponding Patent Abstracts of Japan JP 2003293701 A, dated Oct. 15, 2003.

Patent Abstracts of Japan JP 2001085203 A (Kataoka), dated Mar. 30, 2001.

English language European Patent Application EP 1 431 984 A1 (Yonggang et al.), dated Jun. 23, 2004.

English language European Patent Application EP 0 362 308 B1 (Shrier), dated Apr. 11, 1990, and corresponding German Translation DE 689 28 461 T2, dated Apr. 16, 1998.

English language European Patent Specification EP 0 588 136 B1 (Dorfman), dated Mar. 23, 1994, and corresponding German Translation DE 693 05 942 T2, dated Mar. 13, 1997.

English language European Patent Specification EP 0 853 322 B1 (Hanna et al.), dated Jul. 15, 1998, and corresponding German Translation DE 697 25 692 T2, dated Jul. 22, 2004.

English abstract of French Patent Application FR 2 733 353 A1 (Pham et al.), dated Oct. 25, 1996.

English abstract of German Patent DE 102 12 042 C1 (inventor not named), dated Aug. 14, 2003.

English abstract of German Published Non-Prosecuted Patent Application DE 195 10 100 A1 (Greuter et al.), dated Sep. 26, 1996.

German Search Report dated May 19, 2006.

* cited by examiner

SWITCHING RESISTOR FOR AN ELECTRIC SWITCHING DEVICE

BACKGROUND OF THE INVENTION

Field of the Invention

The invention relates to a switching resistor for an electric switching device, for example a high-voltage circuit breaker, which comprises a resistive material having an electrical resistance.

Electric switching devices such as high-voltage circuit breakers are used among other things for connecting and disconnecting high-voltage overhead lines. Lines of this kind have a defined capacitance per kilometer of line length. In high-voltage and extra-high-voltage networks, particularly long lines are used, which when switched lead to an increase in voltage and/or current due to their capacitance. In order to limit the increases, high-voltage circuit breakers are fitted with switching resistors. For example, a switching resistor forms an auxiliary switching path, which is switched before the actual main switching path is switched, and which has a comparatively high resistance value, which limits a switch-on current. A high-voltage circuit breaker of this kind is described by way of example in DE 29 49 753 A1.

The switching resistors of high-voltage circuit breakers are currently realized by series circuits of disks made from sintered resistive material. Disks of this kind are expensive and have large dimensions.

SUMMARY OF THE INVENTION

The object of the present invention is to provide a switching resistor for an electric switching device, which can be manufactured cost-effectively and/or has smaller dimensions than the switching resistors according to the prior art.

It is a further object of the present invention to provide an electric switching device, in particular a high-voltage circuit breaker, with an improved switching resistor.

The first object is achieved by means of a switching resistor as claimed in claim 1, and the second object by an electric switching device as claimed in claim 14. The dependent claims contain advantageous developments of the invention.

By way of example, a switching resistor can be used to limit an increase in current or an increase in voltage during a switch-on process. However, the switching resistor can also be used to limit overvoltages and/or currents during switch-off processes. Depending on the use, switching resistors are designated as switch-on resistor or switch-off resistor.

A switching resistor according to the invention for an electric switching device comprises an electrically conductive resistive material, which is manufactured on a synthetic material basis. In doing so, the resistive material itself can be an electrically conductive plastic, for example doped polyacethylene, polypyrrol, etc. Advantageously however, the resistive material is an electrically conductively filled plastic, as this can usually be manufactured more cost effectively than a conductive plastic. Here, a conductively filled plastic is understood to mean an electrically non-conductive plastic, which is mixed with a conductive additive. By way of example, graphite, carbon black or a metal powder can be used as the conductive additive. Carbon black in particular, so-called conductivity carbon black, is a product which is easy to process as an additive. The conductive additives can be present in the form of nanoparticles with dimensions in the range from 10 nm to 100 nm, or in the form of macroscopic structures, for example metal fibers with a length of up to a few millimeters. As a further possibility, fullerenes can also be used as a conductive additive, for example the spherical carbon modification of $C_{60}$. In the case of conductivity carbon black as the conductive additive, primary particles are present of the order of magnitude of 10 nm to 100 nm, which ball together to form agglomerates. Basically, therefore, the particles of suitable conductive additives can have dimensions in the range from a few nanometers to several millimeters.

Resistive materials on a synthetic material basis, in particular conductively filled plastics, are cheaper and lighter than the resistive material previously used. They are also less sensitive to the penetration of water and have good mechanical properties over a wide temperature range. Overall, the structure of the whole "switching resistor" component can be simplified.

Particularly in the case of high-voltage circuit breakers for high-voltage lines, an attempt is usually made to match the resistance value of a switch-on resistor to the wave resistance of the line to be switched, which is typically a few hundred ohms, for example 450 ohms. Such a comparatively low specific resistance of the switching resistor can be achieved when the conductive additive is present in the plastic with a super-percolative degree of filling. When a non-conductive plastic is mixed with a conductive additive, then, from a certain critical proportion of the total amount of material of the mixture, this conductive additive forms electrically conductive paths, which extend through the whole mixture, and the mixture becomes conductive. In reality, there exists a sub-percolative range in which the proportion of additive is too small to form conductive paths through the whole material and a super-percolative range in which the proportion of additive is sufficient to form a large number of electrically conductive current paths through the whole material. Between the sub-percolative range and the super-percolative range there exists a transition range in which the increase in the proportion of additive leads to a rapid reduction in the specific resistance, i.e. in the resistance related to a sample with unit length and a unit surface through which current flows. The specific resistance of the resistive material does not then reduce further in the super-percolative range.

By adding at least one macroscopic filler with a high electrical resistance to the resistive material, the resistance value of the switching resistor can be increased without having to change its geometrical dimensions. Adding the macroscopic filler generally does not change the super-percolative nature of a mixture of insulating plastic and conductive additive. In the case of conductivity carbon black as the conductive additive of a conductively filled plastic, the macroscopic particles therefore do not affect the super-percolative microscopic structure of the resistive material. However, the macroscopic filler leads to the proportion of resistive material in the mixture of filler and resistive material in the switching resistor being less than would be the case without the filler. This has the consequence that a smaller effective surface is available for the current for the flow through the switching resistor than without filler material. The resistance value of the switching resistor is given as the product of the specific resistance and the length of the switching resistor divided by the cross-sectional area of the switching resistor through which the current flows. The smaller the cross-sectional area of the switching resistor that can be used for the current flow, the higher its resistance value.

The macroscopic filler can be present in the form of filler particles, for example in the form of glass and/or plastic balls with a high specific resistance, which have dimensions between 0.1 mm and 10 mm.

In an advantageous development of the switching resistor according to the invention, the resistive material comprises a mechanically solid plastic. If the plastic itself is electrically conductive, this can itself be in the form of mechanically solid plastic. If the plastic is non-conductive and is only used as a matrix for a conductive additive, then the non-conductive plastic is preferably realized in the form of a mechanically solid plastic. However, it may be that the mechanical strength can also only be brought about by the electrically conductive additive.

Due to the mechanical strength, a self-supporting structure of the switching resistor is possible, which must only be additionally provided with shrouds and/or ribs to safeguard the durability of the impurity layer. Previous so-called "in-tube structures" in the case of switching resistors with sintered resistive material can then be replaced by completely or partially self-supporting structures. The self-supporting structure can be provided with shrouds or ribs for example by extrusion coating the structure in an injection mold.

Advantageously, the switching resistor according to the invention can be realized as a cast component. Casting the switching resistor enables a flexible form to be achieved so that the switching resistor can be easily adapted to specific geometric requirements.

Furthermore, according to the invention, an electric switching device, in particular a high-voltage circuit breaker, with a switching resistor according to the invention, is provided.

Further features, characteristics and advantages of the present invention can be seen from the following description of exemplary embodiments with reference to the attached figures.

DESCRIPTION OF THE INVENTION

Figure 1:
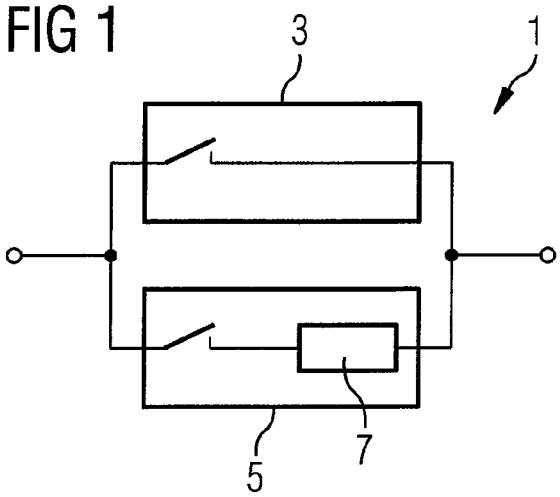
FIG. 1 shows the simplified circuit diagram of a high-voltage circuit breaker as an exemplary embodiment of an electric switching device according to the invention.

A high-voltage circuit breaker is shown in FIG. 1 as an exemplary embodiment of an electric switching device according to the invention in the form of a simplified circuit diagram. The high-voltage circuit breaker shown is a high-voltage circuit breaker such as is used for connecting high-voltage overhead lines in high-voltage and extra-high-voltage networks. It comprises a main switching path 3 and an auxiliary switching path 5 connected in parallel with the main switching path 3. In the switched-on state, the main switching path 3 is used to carry the current between the connected high-voltage line and the high-voltage network. The task of the auxiliary switching path 5 is to limit the switch-on current surge when the high-voltage line is connected. To achieve this, the auxiliary switching path 5 has a switching resistor 7, which works as a switch-on resistor.

A high-voltage line is connected to a high-voltage network by means of the high-voltage circuit breaker 1 of FIG. 1 by first closing the auxiliary switching path 5, whereby the switch-on resistor 7 limits the switch-on current surge through the high-voltage circuit breaker 1. The main switching path 3 is then switched. When the circuit via the main switching path 3 is closed, the auxiliary switching path 5 can be opened again.

Figure 2:
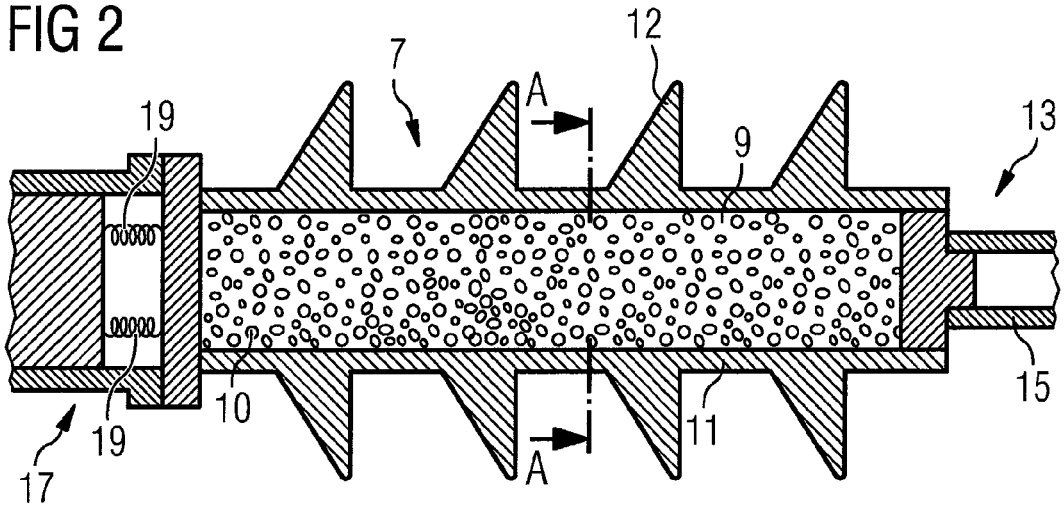
FIG. 2 shows an exemplary embodiment of a switching resistor according to the invention in a schematic sectional view.

A switch-on resistor 7 according to the invention is shown in FIG. 2 in a schematic longitudinal section. It comprises a resistive material 9, which is enclosed by a shroud 11, 12 and arranged between two end fittings 13 and 17.

The end fitting 13 has a contact pin 15, which acts together with a fixed contact (not shown) to close the auxiliary switching path 5. The switch-on resistor 7—and therefore the contact pin 15—is spring-loaded in the switch-off direction by means of springs 19 provided in the end fitting 17 so that the switch-on resistor 7 has to be introduced into the fixed contact against the spring force to switch the auxiliary switching path 5.

The resistive material 9 of the switch-on resistor 7 is a resistive material on a synthetic material basis. In the present exemplary embodiment, a conductively filled plastic, that is to say a plastic material that is mixed with a conductive material, is used. In the present exemplary embodiment, the conductive material is carbon black, so-called conductivity carbon black. Carbon black is particularly suitable because of its easy manageability. However, metal powder, graphite, fullerenes etc. are also suitable as a conductive additive material for the non-conductive plastic.

The proportion of carbon black in the mixture of non-conductive plastic material and carbon black is so high that the carbon black particles form conductive paths in the plastic, which extend from one end fitting to the other. A degree of filling with carbon black of this kind is also referred to as a super-percolative degree of filling.

Macroscopic glass beads with diameters in the range from 0.1 mm to 10 mm are arranged in the resistive material in order to set up a suitable resistance value, for example a resistance value in the range between 200 and 600 ohms, in particular 400 ohms. The insulating glass beads 10 reduce the cross-sectional area, which is available for the current for the current flow through the switch-on resistor 7.

Figure 3:
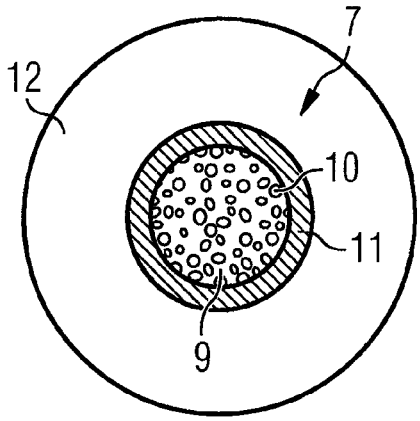
FIG. 3 shows a cross-section view of the switching resistor of FIG. 1 in a section perpendicular to its longitudinal axis.

The reduction in the available cross-sectional area can be seen in FIG. 3, which shows schematically a section along the line A-A shown in FIG. 2. The resistive material 9, the glass beads 10 and the shroud 11 can be seen in FIG. 3. The dimensions of the glass beads are not shown to scale in FIG. 3 for better clarity. Because of their insulating properties, the glass beads 10 oppose a current flow. The current is therefore not able to flow through the area taken up by the glass beads 10. It therefore only has the light area in FIG. 3 available to it.

As the resistance value of the switch-on resistor 7 is given by its specific resistance, the length of the switch-on resistor 7 and the cross-sectional area available for the current flow, the resistance value of the switch-on resistor 7 can be set by the amount of glass beads 10 added. The more glass beads 10 the resistance material 9 contains, the smaller the area available for the current flow, i.e. the greater the resistance value of the switch-on resistor 7. Beads of other non-conductive materials, for example plastic, porcelain etc., can be used instead of the glass beads 10. Also, it is not necessary to use beads. Other geometrical shapes can lead to an equally good result.

The resistive material 9 on a synthetic material basis can be cast enabling the switch-on resistor 7 to be cast in a mold. In the present exemplary embodiment, a silicone elastomer is used as the synthetic material for the switch-on resistor.

Figure 4:
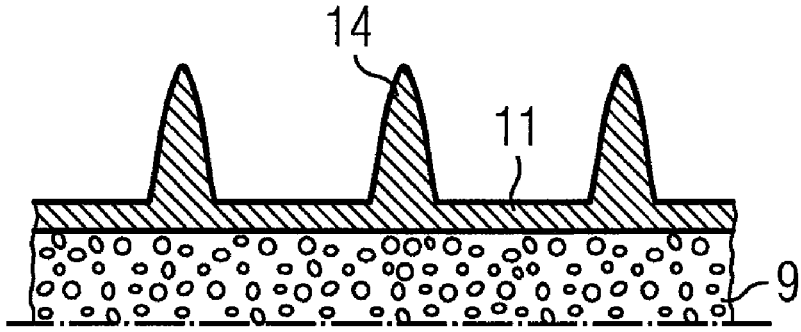
FIG. 4 shows a section of an alternative switching resistor in a schematic sectional view.

When a mechanically solid plastic is used for the resistive material, as shown in FIG. 2, the switch-on resistor 7 can be designed completely or partially as a self-supporting structure, which must only be additionally enclosed by the shroud 11, 12. The shroud, which constitutes a casing 11 with shroud-like projections 12, is used to protect the resistor against environmental influences such as rain, dirt etc. In addition, it increases the so-called creepage distance, that is to say the current path over the outer surface of the resistor. The casing 11 can also have ribs 14, as shown by way of example in FIG. 4, instead of shroud-like projections 12. For simplicity, in the following, the term shroud will also notionally include the variant of the embodiment with ribs instead of with shroud-like projections. The resistive material 9 can be enclosed with the shroud 11, 12, for example by extrusion coating the resistive material 9 with the material of the shroud 11, 12 in an injection mold.

Figure 5:
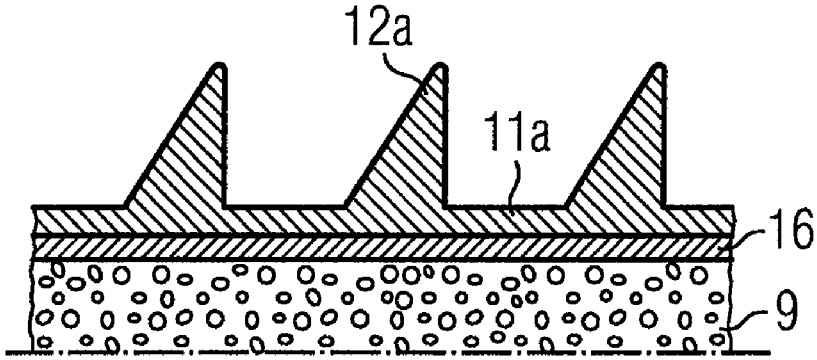
FIG. 5 shows a section of a further alternative switching resistor in a schematic sectional view.
Figure 6:
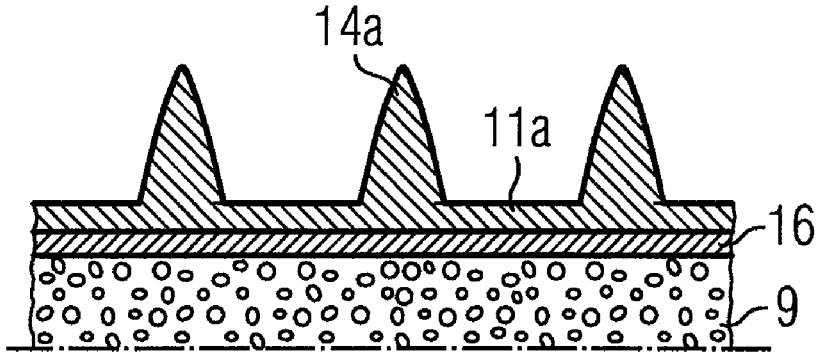
FIG. 6 shows a section of yet another alternative switching resistor in a schematic sectional view.

If a mechanically solid plastic is not used for the resistive material 9, the resistor must be mechanically stabilized, for example by means of a stabilizing tube 16 arranged between the circumference of the resistive material 9 and the shroud 11*a*, 12*a* or 11*a*, 14*a* respectively (cf. FIG. 5 and FIG. 6). The resistive material 9 can be enclosed by the tube 16 for example by casting the resistive material 9 in the tube 16. However, it is also possible to cast the resistive material 9 in a mold and to fit this later by insertion in the tube 16. In addition, unlike the examples shown in FIGS. 5 and 6, it is also possible for the shrouds 12*a* and the ribs 14*a* to be formed as part of the tube 16.

In variance with the exemplary embodiment shown in FIG. 2, in which the resistive material 9 is a silicone elastomer mixed with carbon black, the resistive material 9 can also be made from a conductive plastic, for example from doped polyacethylene, i.e. polyacethylene mixed with foreign substances, from polypyrrol, or from other conductive plastics. Unlike conductively filled synthetic material, the foreign substances do not form conductive paths in doped synthetic material, but instead change the electrical properties of the doped synthetic material itself so that this becomes conductive. The proportion of foreign substances in doped synthetic material lies well below the proportion of foreign substances in conductively filled synthetic material so that the proportion of foreign substances would not be sufficient for a super-percolative degree of filling. In other words, the concentration of foreign substances prevailing in doped synthetic materials would not be sufficient to produce conductive paths between the two end fittings.

LIST OF REFERENCES

1 High-voltage switch
3 Main switching path
5 Auxiliary switching path
7 Switch-on resistor
9 Resistive material
10 Glass beads
11 Casing
11*a* Casing
12 Shroud-like projection
12*a* Shroud-like projection
13 End fitting
14 Rib
14*a* Rib
15 Contact pin
16 Tube
17 End fitting
19 Spring

The invention claimed is:

1. A switching resistor for an electric switching device, comprising:

an electrically conductive resistive material based on a synthetic material;

said resistive material including a non-conductive synthetic material, a conductive additive mixed with said synthetic material with a super-percolative degree of filling, and at least one macroscopic filler having a high electrical resistance; and said resistive material having a resistance value being set by an amount of said filler mixed with said synthetic material.

2. The switching resistor according to claim 1, wherein said resistive material is an electrically conductive plastic.

3. The switching resistor according to claim 1, wherein said conductive additive is graphite.

4. The switching resistor according to claim 1, wherein said conductive additive is carbon black.

5. The switching resistor according to claim 1, wherein said conductive additive is a metal in powder form or in fiber form.

6. The switching resistor according to claim 1, wherein said conductive additive comprises fullerenes.

7. The switching resistor according to claim 1, wherein said macroscopic filler is present in particle form with filler particles having dimensions between 0.1 mm and 10 mm.

8. The switching resistor according to claim 1, wherein said macroscopic filler is present in particle form of spherical particles having a high specific resistance.

9. The switching resistor according to claim 8, wherein said spherical particles are selected from the group consisting of spherical glass particles and plastic particles.

10. The switching resistor according to claim 1, wherein said resistive material comprises a mechanically solid plastic.

11. The switching resistor according to claim 1, wherein said resistive material is a cast part.

12. An electric switching device, comprising a switching resistor according to claim 1.

13. A high-voltage circuit breaker, comprising:

a main switching path and an auxiliary switching path connected in parallel with said main switching path; and said auxiliary switching path having a switching resistor according to claim 1.

14. The switching resistor according to claim 1, wherein synthetic material is a plastic material.

* * * * *